US007237308B2

(12) United States Patent
Dixon et al.

(10) Patent No.: US 7,237,308 B2
(45) Date of Patent: Jul. 3, 2007

(54) COMPOSITE HYDROENTANGLING NOZZLE STRIP AND METHOD FOR PRODUCING NONWOVEN FABRICS THEREWITH

(75) Inventors: Michael D. Dixon, Pinehurst, NC (US); James T. Lowder, Columbus, OH (US); Behnam Pourdeyhimi, Cary, NC (US); Hooman Vahedi Tafreshi, Raleigh, NC (US)

(73) Assignees: North Carolina State University, Raleigh, NC (US); Advanced Fluid Technologies, Inc., Aberdeen, NC (US)

( * ) Notice: Subject to any disclaimer, the term of this patent is extended or adjusted under 35 U.S.C. 154(b) by 257 days.

(21) Appl. No.: 10/865,461

(22) Filed: Jun. 10, 2004

(65) Prior Publication Data

US 2005/0273989 A1 Dec. 15, 2005

(51) Int. Cl.
*D04H 1/46* (2006.01)
*D06B 1/02* (2006.01)

(52) U.S. Cl. ..... 28/104; 28/167

(58) Field of Classification Search ..... 28/104, 28/105, 167, 106; 239/266, 533, 566, 589, 239/555, 591, 553.3, 553.5, 554, 556, 557
See application file for complete search history.

(56) References Cited

U.S. PATENT DOCUMENTS

| | | | | |
|---|---|---|---|---|
| 3,033,721 A | | 5/1962 | Kalwaites | |
| 3,403,862 A | * | 10/1968 | Dworjanyn | 28/104 |
| 3,705,693 A | | 12/1972 | Franz | 239/600 |
| 3,750,961 A | | 8/1973 | Franz | 239/600 |
| 4,478,368 A | | 10/1984 | Yie | 239/430 |
| 4,805,275 A | | 2/1989 | Suzuki et al. | 28/104 |
| 4,936,512 A | | 6/1990 | Tremoulet, Jr. | 239/596 |
| 5,033,681 A | | 7/1991 | Munoz | |
| 5,199,640 A | | 4/1993 | Ursic | 239/11 |
| 5,620,142 A | * | 4/1997 | Elkas | 239/596 |
| 5,848,753 A | | 12/1998 | Wands et al. | 239/596 |
| 5,970,593 A | | 10/1999 | Sear | 28/272 |
| 6,012,654 A | | 1/2000 | Fleissner | |

(Continued)

FOREIGN PATENT DOCUMENTS

DE 9419809.8 * 1/1995

(Continued)

OTHER PUBLICATIONS

International Preliminary Report on Patentability dated Dec. 28, 2006.

*Primary Examiner*—Amy B. Vanatta
(74) *Attorney, Agent, or Firm*—Jenkins, Wilson, Taylor & Hunt, P.A.

(57) ABSTRACT

A composite nozzle strip for hydroentangling of a fibrous mass is provided to lower nozzle erosion potential and increase operational efficiency. The composite nozzle strip comprises a substrate comprising a material of a first hardness having at least one aperture and at least one orifice element comprising a material of a second hardness greater than the first hardness and further defining an aperture of a second diameter less than the first diameter. The at least one orifice element is affixed to the substrate so that the aperture in the orifice element is aligned with the at least one aperture in the substrate for creation of a constricted water jet when subjected to pressurized water.

67 Claims, 11 Drawing Sheets

U.S. PATENT DOCUMENTS

| | | | | |
|---|---|---|---|---|
| 6,668,436 | B2 | 12/2003 | Noelle et al. | |
| 6,805,303 | B2 | 10/2004 | Hess et al. | |
| 2003/0167934 | A1 | 9/2003 | Hansen et al. | 99/532 |
| 2004/0026543 | A1* | 2/2004 | Fleissner | 239/566 |
| 2004/0164173 | A1 | 8/2004 | Jarachu | |
| 2005/0133641 | A1* | 6/2005 | Chung | 239/596 |

FOREIGN PATENT DOCUMENTS

| | | | |
|---|---|---|---|
| DE | 19849814 | A1 * | 5/2000 |
| DE | 19941729 | A1 * | 3/2001 |
| GB | 2178342 | A * | 2/1987 |
| WO | WO 01/44553 | A1 * | 6/2001 |

* cited by examiner

FIGURE 1A (PRIOR ART)
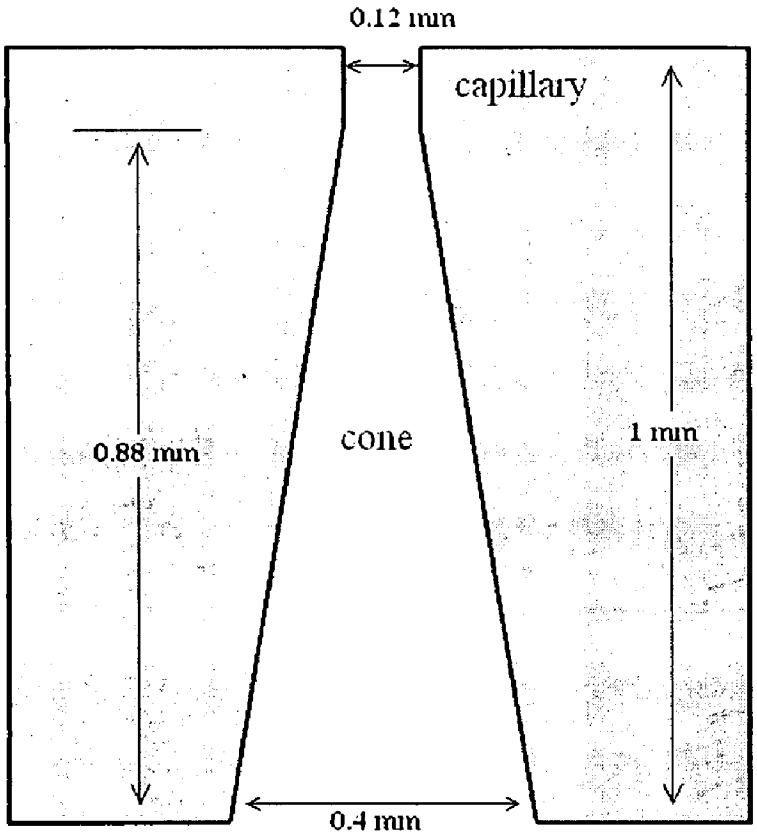
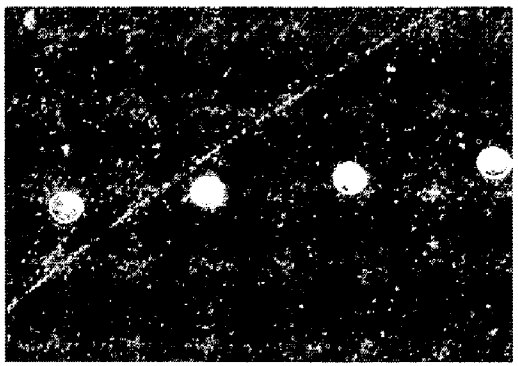
FIGURE 1B (PRIOR ART)
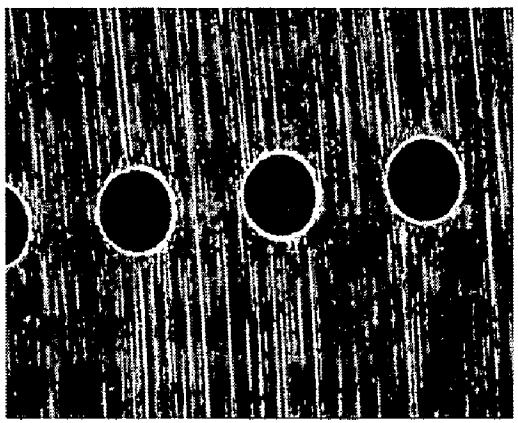
FIGURE 1C (PRIOR ART)

CONCEPT PLAN VIEWS
22B
26

20
Substrate
22B
26

26
20
ORIFICE ELEMENT
AA
26B
20
26
22B

22
A
26A
22A
Stainless Steel or
Other Substrate
Adhesive
Bond

CONCEPT PLAN VIEWS
32B
30
34

36
POSITIONING STRIP
FOR LOCATING ELEMENTS
Substrate
32B
30
36
34

POSITIONING STRIP
36B
AA
ORIFICE ELEMENT
34
36
30

32B
32
A
32A
36A
Adhesive
Bond
Stainless Steel or
Other Substrate

COMPOSITE HYDROENTANGLING NOZZLE STRIP AND METHOD FOR PRODUCING NONWOVEN FABRICS THEREWITH

TECHNICAL FIELD

The subject matter disclosed herein relates generally to apparatuses and methods for producing nonwoven fabrics through the hydroentangling process, and more particularly to providing a composite hydroentangling nozzle strip for mechanically bonding a fibrous mass.

BACKGROUND ART

Hydroentanglement or "spunlacing" is a process used for mechanically bonding a web of loose fibers to form fabrics directly from fibers. Fabrics formed by the hydroentanglement process typically belong to those in the nonwovens' family of engineered fabrics. The underlying mechanism in hydroentanglement is the subjecting of the fibers to a non-uniform pressure field created by a successive bank of high-velocity water jets. The impact of the water jets with the fibers, while they are in contact with their neighbors, displaces and rotates the fibers with respect to their neighbors and entangles the same with neighboring fibers. During these relative displacements, some of the fibers twist around and/or inter-lock with neighboring fibers to form a strong structure based upon frictional forces between the fibers touching one another. The final outcome of the hydroentanglement process is a highly compressed and uniform fabric composed of entangled fibers. These structures are highly flexible, yet are very strong and outperform their woven and knitted counterparts in many measures of performance. The process is a high-speed low-cost alternative to other methods of producing fabrics wherein typical hydroentangling machines can run as fast as 700 meters or more per minute and are typically 1 to 6 meters wide. The process owes its success to the peculiar properties of coherent high-speed water jets.

Various patents have issued that are directed to the hydroentangling process in general and several have attempted to solve the serious problem of nozzle erosion that is inherent with high water pressures. U.S. Pat. No. 3,033,721 is directed to a method and apparatus for producing foraminous fabrics from a layer of fibrous material such as a fibrous web wherein the individual fiber elements are capable of movement under the influence of an applied fluid force. U.S. Pat. No. 4,805,275 is directed to a method of producing nonwoven fabrics through a treatment with high velocity water streams wherein a fibrous web is treated on a water impermeable supporting member with water jet streams ejected from a nozzle. The nozzle disclosed in the '275 Patent is a cone-capillary nozzle (i.e., cone-up nozzle) which results in a non-constricted water jet with minimal effective breakup length. U.S. Pat. No. 6,668,436 is directed to a method of treating sheet material using pressurized waterjets wherein a perforated plate with inserts made of zirconia, sapphire, ruby or other materials of equivalent hardness are used to increase the life of the nozzles. The inserts disclosed in the '436 Patent suffer from inherent design and machining problems that lower their efficiency and raise operating costs.

Therefore, it would be advantageous to employ a composite hydroentangling nozzle strip that could be subjected to the extremely high pressures found in today's hydroentangling machines without failing due to premature erosion of the nozzle inlet edge. It would also be advantageous to employ a composite hydroentangling nozzle strip that could withstand the erosion properties of cavitation while allowing a constricted water jet to form within the nozzle assembly. Finally, it would be advantageous to utilize a composite hydroentangling nozzle strip that can be easily and cost effectively maintained by the end user.

DISCLOSURE OF THE INVENTION

I. Hydroentangling Technology

Hydroentangling water jets are typically issued from thin-plate strips 1 to 6 meters long with a thickness of about 1 millimeter and having 1600–2000 orifices per meter. As shown in FIGS. 1A–1C, the orifices in typical hydroentangling nozzle strips are traditionally made up of two sections: a cylindrical or capillary section with a typical diameter of about 120 microns (see FIG. 1B for top view of strip and capillary opening), connected to a slim cone with an angle of about 18 degrees (see FIG. 1C for bottom view of strip and cone opening). Manufacturing thousands of such delicate tiny orifices next to each other places many constraints on the design process.

Typically, the manufacturing process starts by first drilling a cone deep into the strip and then punching or drilling the desirable capillary hole from the other end only after the thickness has been reduced adequately. Manufacturing limitations are, in part, responsible for the cone-capillary geometry that has been used since the inception of hydroentangling some thirty years ago. While this geometry has worked well for the past thirty years, over the last five years the operating pressures employed in the hydroentangling process have increased from 100 bars to over 500 bars and strips that lasted months previously now only last a few days. Therefore, there is a need for better and longer lasting hydroentangling nozzle strips.

Because water jets are the main mechanical element of the hydroentangling technique, it is important that they maintain their kinetic energy in a constricted manner downstream of their orifice for an appreciable distance. Despite this critical requirement, water jets by nature break up somewhere downstream of the nozzle exit. Once a water jet turns into spray (or broken water jet), its kinetic energy is divided among thousands of very fine droplets. Broken water jets have practically no utility and consequently are not able to entangle fibers efficiently. Therefore it is vitally important to maintain a water jet in a constricted manner for as long as possible.

The peculiar property of hydroentangling nozzles that allows for a constricted water jet is that their sharp inlets cause the flow to separate from the nozzle wall and form a vena contracta at the moment they enter the passage or capillary. Using a Computational Fluid Dynamics (CFD) code from Fluent Inc., applicants solved the Reynolds-Averaged Navier-Stokes equations (RANS) in an axi-symmetric geometry. The appropriate two-phase flow solution method implemented in the Fluent code is the Volume of Fluid (VOF) method wherein a single set of momentum equations is shared by the phases (water and air), and the volume fraction of each of the fluids in each computational cell is tracked throughout the domain, resulting in the prediction of the water-air interface in the whole domain. FIG. 2 shows the contour plots of the water-air mixture density (in $kg/m^3$) for a typical hydroentangling nozzle. The capillary section is enlarged in the picture to the right where it can be seen that the flow stays detached all the way through the nozzle body. As shown in FIG. 3, when the flow separates from the nozzle wall, downstream air is pulled in through the nozzle exit and fills the gap between the water jet and the nozzle wall. This gap filling forms an envelope around the water flow, which results in formation of a constricted water jet.

A constricted water jet is a coherent water jet formed from a detached nozzle flow and resulting in a glassy appearance and long breakup lengths. FIGS. 4A and 4B detail the profile of a constricted water jet at a pressure of 138 bars and FIGS. 5A and 5B show a non-constricted waterjet at the same pressure. It can be seen that the constricted water jet has kept its solid integrity for an appreciable distance from the nozzle exit while the non-constricted water jet has almost no breakup length and turns into spray almost immediately after the nozzle exit. FIGS. 4A and 4B shows the water jet breakup regime, called the first wind-induced breakup regime, wherein water drops are pinched off from the end of a long and continuous glassy column of water. A constricted water jet is laminar and has an axially symmetric wavy appearance with a long breakup length. In the first wind-induced breakup regime of the constricted water jet, the formed droplets have a diameter close to the jet diameter and so they maintain high-speed parcels of momentum. In contrast, as shown in FIGS. 5A and 5B, the micron-size droplets in the spray generated by the non-constricted water jet lose their velocity very rapidly and disperse in the downstream air leading to an ineffective water jet for hydroentangling purposes.

One of the main hydroentangling nozzle properties that allow for a constricted water jet is a sharp inlet in order to promote the vena contracts effect at the moment the water enters the passage or capillary of the nozzle. Therefore, an important concern in the hydroentangling process is the effect of orifice erosion, which can render the nozzle strip ineffective after a relatively short period of time due to the lack of water jet constriction. FIGS. 6A and 6B depict pictures taken by a Burleigh Horizon non-contact green laser microscope of a typical hydroentangling nozzle strip in new condition and after use, respectively. FIG. 6A depicts a new nozzle shown having sharp inlets whereas FIG. 6B depicts a used nozzle with eroded edges. Eroded nozzles do not have sharp-edge inlets and once the inlet loses its sharpness, the orifice will no longer be capable of generating a constricted water jet.

Water jet breakup is known to also occur due to a number of different parameters, including nozzle geometry. Recent studies have shown that the main cause of the water jet breakup is the strong disturbances that appear in the flow because of cavitation inside the nozzle. Cavitation refers to the condition where bubbles (made of vapor or dissolved gases) form in liquid because of the local pressure drop inside a hydraulic system and can change the regime of a nozzle flow. In particular, in the case of nozzles with a sharp inlet, boundary layer separation will cause the main flow to follow a curved path around a separated but liquid-filled region. If the flow velocity is high enough to cause the pressure on the separated region to drop to water vapor pressure, vaporization will occur and a cavitation pocket will form. When cavitation occurs, a vapor cloud consisting of a large number of fine bubbles forms at the nozzle inlet and moves towards the nozzle exit. Bubbles may or may not collapse in high-pressure zones but in any case they strongly disturb the flow steadiness inside the nozzle and affect the velocity profile. Once the cavitation cloud moves downstream, another cloud appears and the irregular formation-growth-dispersion (or collapse) repeats. When flow leaves the nozzle, the ambient air amplifies cavitation-induced instabilities and accelerates the water jet breakup.

If the above-mentioned cavitation cloud reaches the nozzle outlet before it disperses, downstream air comes into the nozzle, fills the cavity and cavitation stops in a phenomenon called hydraulic flip. Cavitation is desirable if it ends up with a hydraulic flip inside the nozzle due to the generation of a constricted waterjet with a long breakup length. However, intermediate levels of cavitation (cavitating flow) results in a rapid disintegration of the water jet as well as strong erosion inside the nozzle due to the collapse of cavitation bubbles close to the nozzle surface which generates a strong pressure wave and rapid deterioration of the nozzle surface.

While cavitation is desirable if it ends up with a hydraulic flip, a cavitation-free nozzle would also result in a constricted water jet. A cavitation-free nozzle flow could be performed in a nozzle where the inlet roundness is so great that no boundary separation between the water flow and the nozzle surface occurs. In order to produce inlet roundness of such an extent, surface finish and manufacturing precision are extremely important and manufacturing thousands of holes requiring such degree of precision is a major engineering challenge. It is therefore not surprising that cavitation-free nozzles are not feasibly or economically possible in hydroentangling. Therefore, generation and protection of sharp inlets in a hydroentangling nozzle where cavitation and hydraulic flip can occur is desired.

Similar to compressible flows where excessive pressure ratio across the nozzle can choke the throat, a water flow nozzle becomes choked if its operating pressure is sufficiently high and its inlet sharpness is above a critical value. That is the case where cavitation causes a hydraulic flip to occur inside the nozzle. At the point of hydraulic flip, the nozzle discharge coefficient, defined as the amount of the actual flow rate to that obtained by the one-dimensional inviscid theory, drops to a value about 0.62 and stays almost constant independent of the nozzle working pressure.

Nozzle cavitation is usually presented in terms of the cavitation number defined as:

$$K = \frac{P_1 - P_v}{P_1 - P_2} \qquad \text{Eq. (1)}$$

where $P_1$, and $P_2$, are the pressures upstream and downstream of the nozzle, respectively. $P_v$ is the water vapor pressure at room temperature. Since $P_v$ is normally smaller that $P_2$, the cavitation number is usually greater than unity. In hydroentangling operating condition, $P_2$ is atmospheric pressure and more than 40 times greater than $P_v$. The higher the pressure ratio across the nozzle, the lower is the cavitation number. Note that large cavitation numbers are typical of non-cavitating (single-phase) flows.

To determine the viscous regime of the flow, one must define Reynolds number as follows:

$$\mathrm{Re} = \frac{d_n \rho V}{\mu} \qquad \text{Eq. (2)}$$

where $\rho$ and $\mu$ are water density and viscosity, respectively, and $d_n$ is the nozzle inlet diameter. We defined the Reynolds number based on the manifold pressure (nozzle upstream pressure) and the nozzle diameter. Velocity V of the jet can be calculated from the manifold pressure using one-dimensional inviscid theory as follows:

$$V = \sqrt{\frac{2(P_1 - P_2)}{\rho}} \quad \text{Eq. (3)}$$

To determine whether the nozzle flow is cavitating (flow is not perfectly detached from the nozzle wall), flipped (detached all the way through the nozzle), or non-cavitating (pure single-phase flow) we consider $K_{incep}$ indicative of the cavitation inception and $K_{crit}$ indicative of the hydraulic flip inside the nozzle:

$$K_{incep} = 1.9(1 - r/d_n)^2 - \frac{1000}{\mathrm{Re}} \quad \text{Eq. (4)}$$

$$K_{crit} = 1 + \left[\left(1 + \frac{L}{4d_n}\right)\left(1 + \frac{2000}{\mathrm{Re}}\right)\right]^{-1} \exp\left(-\frac{70r}{d_n}\right) \quad \text{Eq. (5)}$$

As shown in FIG. 7, experimental correlations were plotted for two distinct manifold pressures of 15 and 150 bars versus the inlet radius of curvature. Note that cavitation number, K, for these pressures are almost one. It can be seen from the figure that by increasing the inlet roundness, the cavitation number associated with inception of the bubbles, $K_{incep}$, decreases. By further increasing the inlet roundness to r/d=0.2 (for a 15-bar pressure) and r/d=0.25 (for a 150-bar pressure), $K_{incep}$ goes below the cavitation number of unity ($K \cong 1$) (r and d are the entrance radius of curvature and the nozzle diameter, respectively). In this case no cavitation is expected to occur and there will be a pure single-phase nozzle flow.

However, as discussed above, such a high degree of roundness makes the manufacturing process extremely complicated and cannot be a solution for hydroentangling nozzles. FIG. 7 further shows that the critical cavitation number is greater than the cavitation number ($K \cong 1$) at small radius of curvatures for both of the pressures considered. It decays rapidly by increasing roundness and reaches a plateau at about r/d=0.06. Hydraulic flip is expected to occur for r/d<0.06 (since $K_{crit}>K$). Once the hydraulic flip occurs, cavitation will stop because the aforementioned low-pressure region is filled with ambient air. This indicates that in order to have a constricted water jet, the nozzle inlet roundness should be smaller than $r/d \cong 0.06$ for both of the pressures. For the inlet roundness greater than 0.06, since $K<K_{incep}$, we expect to have a cavitating flow and resulting non-constricted spray water jet.

In order to investigate the validity of the above correlations as well as cavitation time and length scales, an unsteady state simulation performed for the capillary section of a typical hydroentangling nozzle was undertaken. FIG. 8 depicts a contour plot of water flows from a reservoir at a pressure of 150 bars through a sharp-edge cone-down nozzle (r/d=0.01) and shows how a cavitation cloud forms and extends toward the outlet and eventually causes the hydraulic flip to occur. It can be seen that the simulation results are in very good agreement with the correlations shown in FIG. 7. FIG. 8 shows that flow separation start to take place after about 10 microseconds from the inception of cavitation and the cavitation cloud grows with time until at about 60 microseconds after the inception where flow gets entirely detached from the wall due to hydraulic flip.

II. Novel Nozzle and Method of Use

According to one embodiment, a composite nozzle strip for hydroentangling of a fibrous mass comprises a substrate having a first side surface and a second side surface and comprising a material of a first hardness, the substrate having at least one aperture of a first diameter. The composite nozzle strip further comprises at least one orifice element having a first side surface and a second side surface and comprising a material of a second hardness greater than the first hardness, and further defining an aperture of a second diameter less than the first diameter. The first side surface of the at least one orifice element is affixed to the second side surface of the substrate so that the aperture in the at least one orifice element is aligned with the at least one aperture in the substrate.

According to another embodiment, a composite nozzle strip for hydroentangling of a fibrous mass comprises a substrate having a first side surface and a second side surface and comprising a material of a first hardness, the substrate having a plurality of apertures of a first diameter. The composite nozzle strip further comprises a positioning strip including a plurality of orifice elements, each orifice element having a first side surface and a second side surface and comprising a material of a second hardness greater than the first hardness, and further defining an aperture of a second diameter less than the first diameter. The positioning strip is placed on the substrate so that the first side surfaces of the plurality of orifice elements are affixed to the second side surface of the substrate so that the apertures of the plurality of orifice elements are aligned with the plurality of apertures in the substrate.

According to yet another embodiment, a composite nozzle strip for hydroentangling of a fibrous mass comprises a substrate having a first side surface and a second side surface and comprising a material of a first hardness, the substrate having a plurality of apertures of a first diameter. The composite nozzle strip further comprises an orifice strip having a first side surface and a second side surface and comprising a material of a second hardness greater than the first hardness, the orifice strip having a plurality of apertures of a second diameter less than the first diameter. The first side surface of the orifice strip is affixed to the second side surface of the substrate so that the plurality of apertures in the orifice strip are aligned with the plurality of apertures in the substrate.

Methods are also provided for producing nonwoven fabrics with the novel composite nozzle strips. The methods generally comprise providing a substrate comprising a material of a first hardness, the substrate having a plurality of apertures of a first diameter, and providing orifice elements (alone or in a positioning strip) further defining an aperture or providing an orifice strip having a plurality of apertures wherein the orifice elements or orifice strip comprise a material of a second hardness greater than the first hardness and further wherein the apertures defined in the orifice elements or orifice strip are of a second diameter less than the first diameter. The methods further comprise affixing the orifice elements or orifice strip to the substrate so that the apertures in the orifice elements or orifice strip are aligned with the plurality of apertures in the substrate, exposing the apertures of the orifice elements or orifice strip to pressurized water to form at least one water jet, guiding a fibrous web onto a supporting member beneath the at least one water jet, and subjecting the fibrous web to the at least one water jet and thereby providing enhanced cohesion and appearance modification to the fibrous web.

It is therefore an object to provide composite hydroentangling nozzle strip apparatuses and methods for use thereof for producing nonwoven fabrics through the hydroentangling process.

An object having been stated hereinabove, and which is achieved in whole or in part by the subject matter disclosed herein, other objects will become evident as the description proceeds when taken in connection with the accompanying drawings as best described hereinbelow.

BRIEF DESCRIPTION OF THE DRAWINGS

FIGS. 1A–1C are vertical cross-section, top and bottom plan views, respectively, of a typical hydroentangling nozzle strip;

DETAILED DESCRIPTION OF THE INVENTION

As discussed above, conventional hydroentangling nozzles made of stainless steel and other metals are known to undergo severe erosion in a relatively short period of time. At higher pressures, the nozzles tend to erode more rapidly, which leads to formation of a non-constricted water jet, or spray, which lowers the effectiveness of the hydroentangling process. Nozzles that fail due to erosion must be replaced, imposing a large replacement cost for the process and an undesirable stoppage in production line. Other prior art nozzles have incorporated other materials, such as sapphire, inside the nozzle assembly itself, but this has led to numerous production problems inherent with replacing inner parts of nozzle strip assemblies.

Applicants have discovered a novel composite hydroentangling nozzle strip which has a higher degree of erosion resistance than previous prior art nozzle strips. The improved composite nozzle strip comprises a substrate, such as non-corrosive stainless steel, and exploits a surface mounted more wear resistant material (single crystal materials such as sapphire, diamond or other hard, wear resistant materials) for the entrance section and/or channeling and exit sections of nozzles in hydroentangling jet strips. Sapphire and diamond have well-known erosion resistant properties and are able to tolerate the adverse operating condition of the hydroentangling process for an appreciably longer period of time than current materials in existing nozzle designs. The lifetime of such designs will be significantly extended over current designs such that structural integrity of the composite rather than wear of the nozzle will become the limiting factor in life.

This present invention will employ sapphire or other wear resistant materials as orifice elements in hydroentangling nozzle strips having as many as 1 to 200 holes per inch. The thickness of the orifice element provides the desirable specifications for the designated operating pressure without concern for the strength of the orifice element or sealing of the orifice element against leakage. Due to improved erosion resistance, the composite nozzles of the present invention will provide much longer continuous operation of machines and associated cost savings while simultaneously providing greater ranges of operational parameters and improved performance at much higher pressures (e.g., in excess of 1,000 bars or 14,500 psi) than conventional hydroentangling strips.

Figure 2:
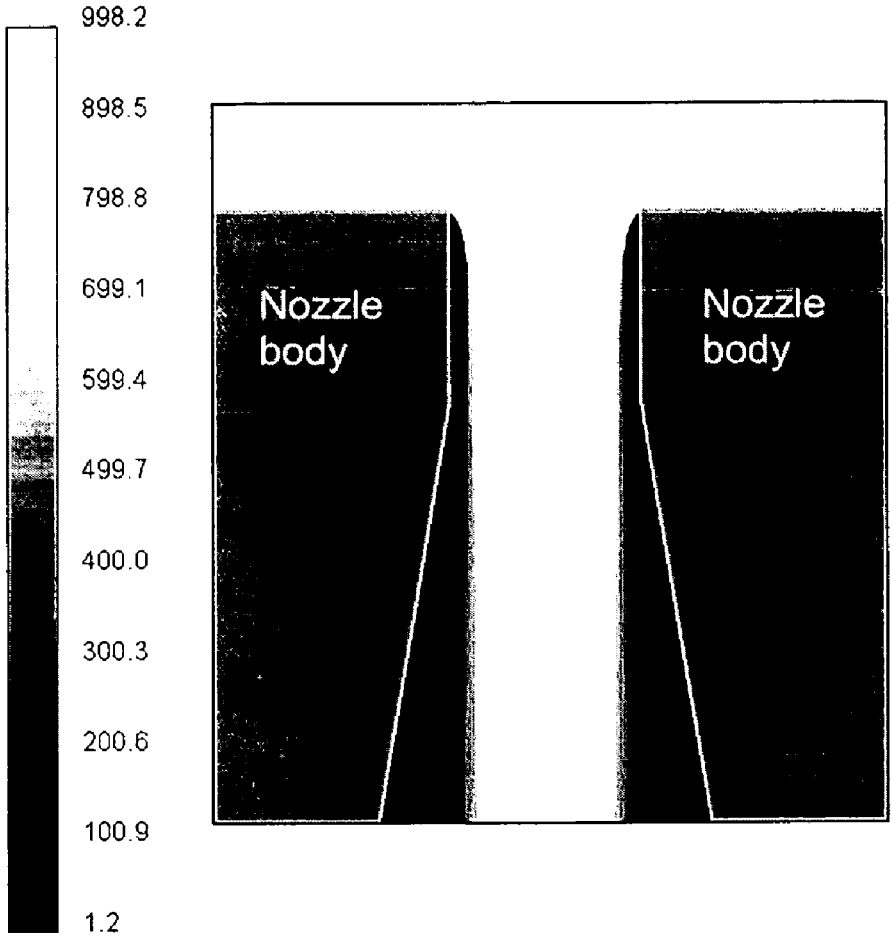
FIGURE 2 (PRIOR ART)
FIG. 2 is a contour plot of the mixture density (in kg/m$^3$) for cone-down geometry in a typical hydroentangling nozzle strip.
Figure 3:
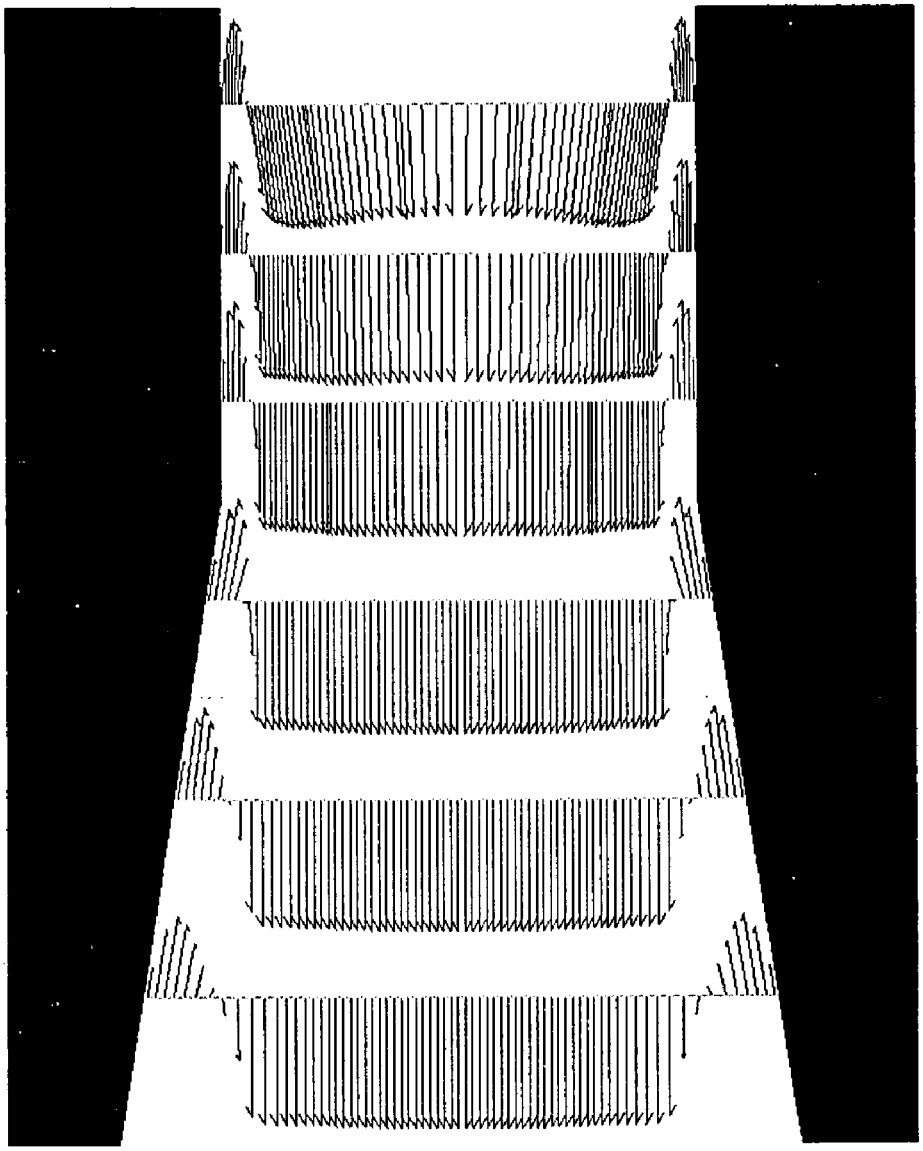
FIGURE 3 (PRIOR ART)
FIG. 3 is a vertical cross-section view indicating velocity vectors inside a typical hydroentangling nozzle strip.
Figures 4A, 4B:
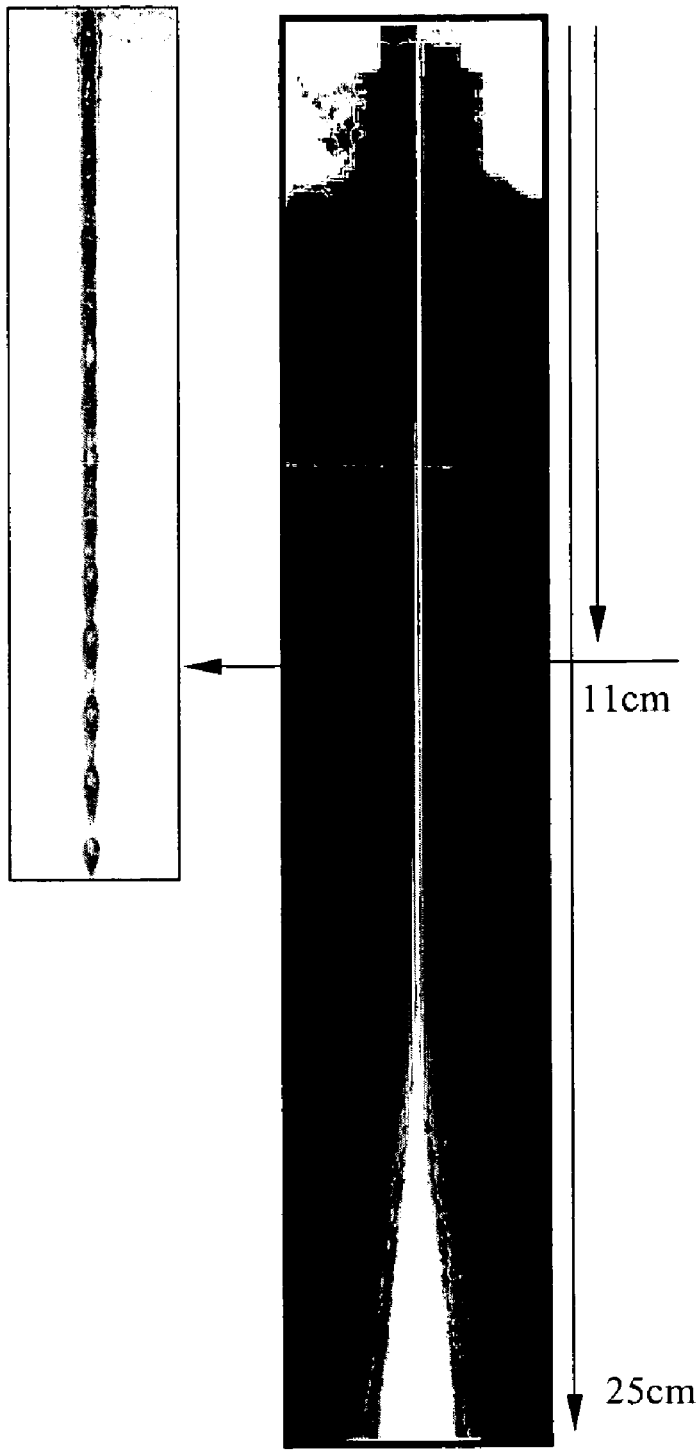
FIGS. 4A and 4B are profiles of a constricted water jet at a pressure of 138 bars imaged using a high-speed camera and a regular camera, respectively.
Figure 5A:
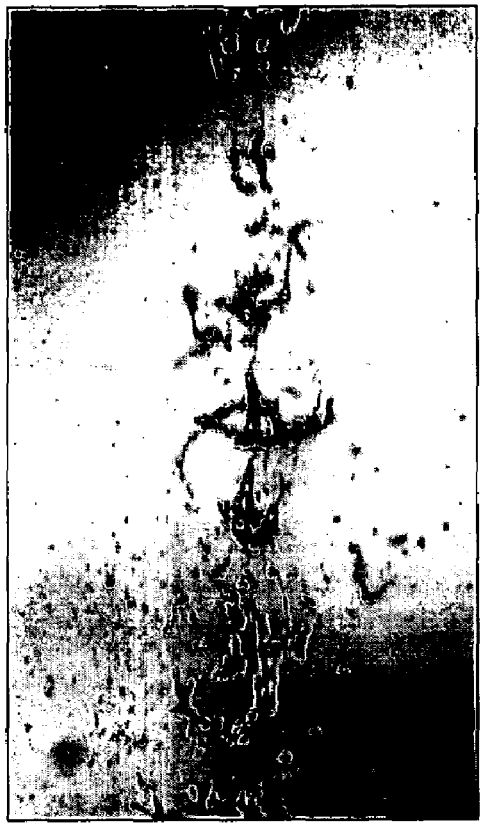
FIGS. 5A and 5B are profiles of a non-constricted water jet at a pressure of 138 bars imaged using a high-speed camera and a regular camera, respectively.
Figure 5B:
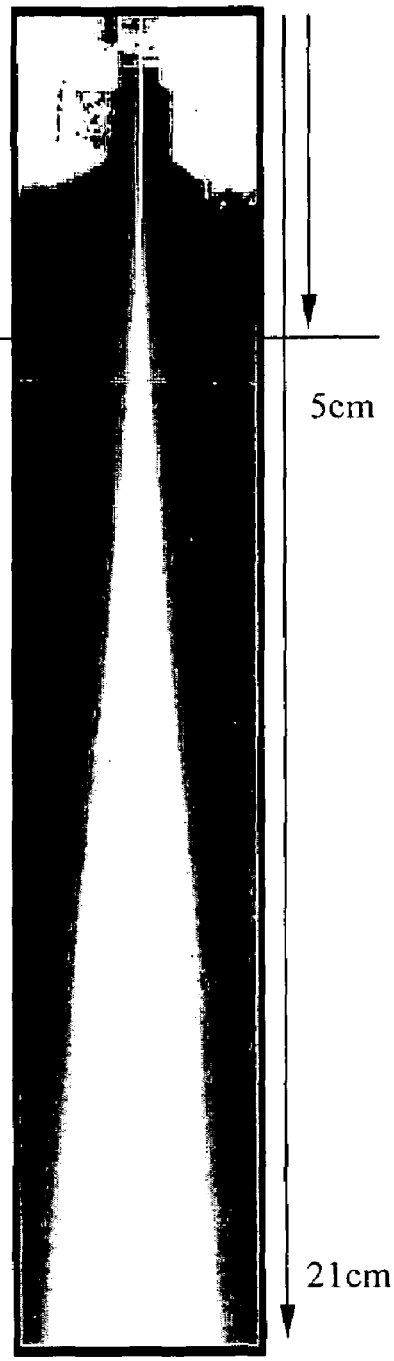
Figure 6A:
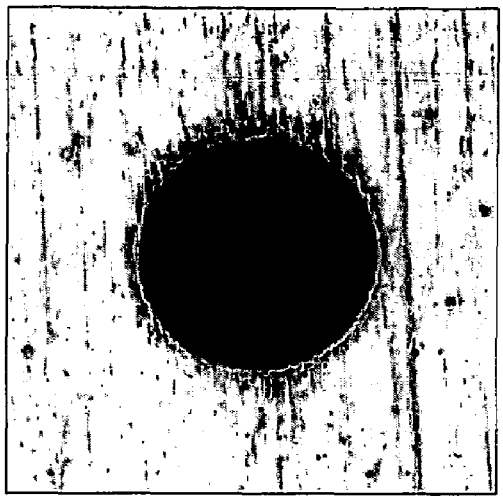
FIGURE 6A (PRIOR ART)
FIGS. 6A and 6B are top plan views of a typical hydroentangling nozzle strip in new condition and after use, respectively.
Figure 6B:
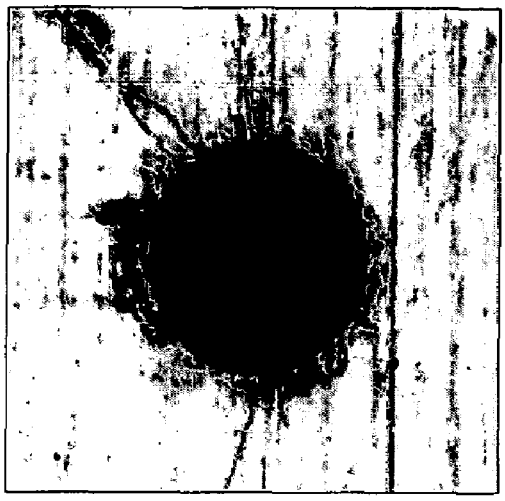
FIGURE 6B (PRIOR ART)
Figure 7:
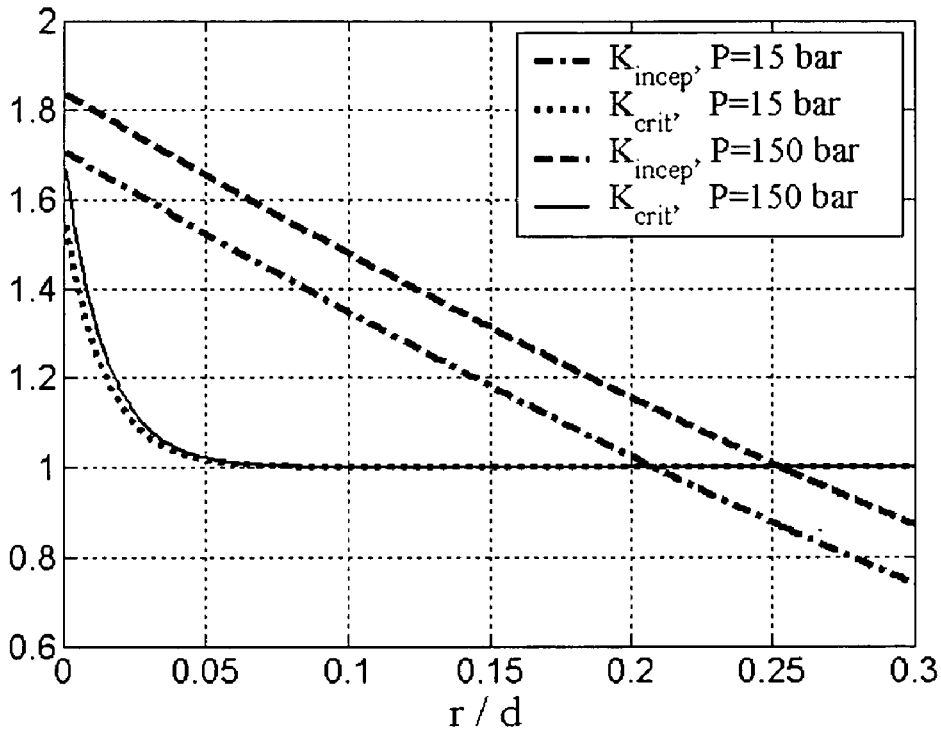
FIG. 7 is a chart plotting the effect of inlet roundness on the state of nozzle cavitation.
Figure 8:
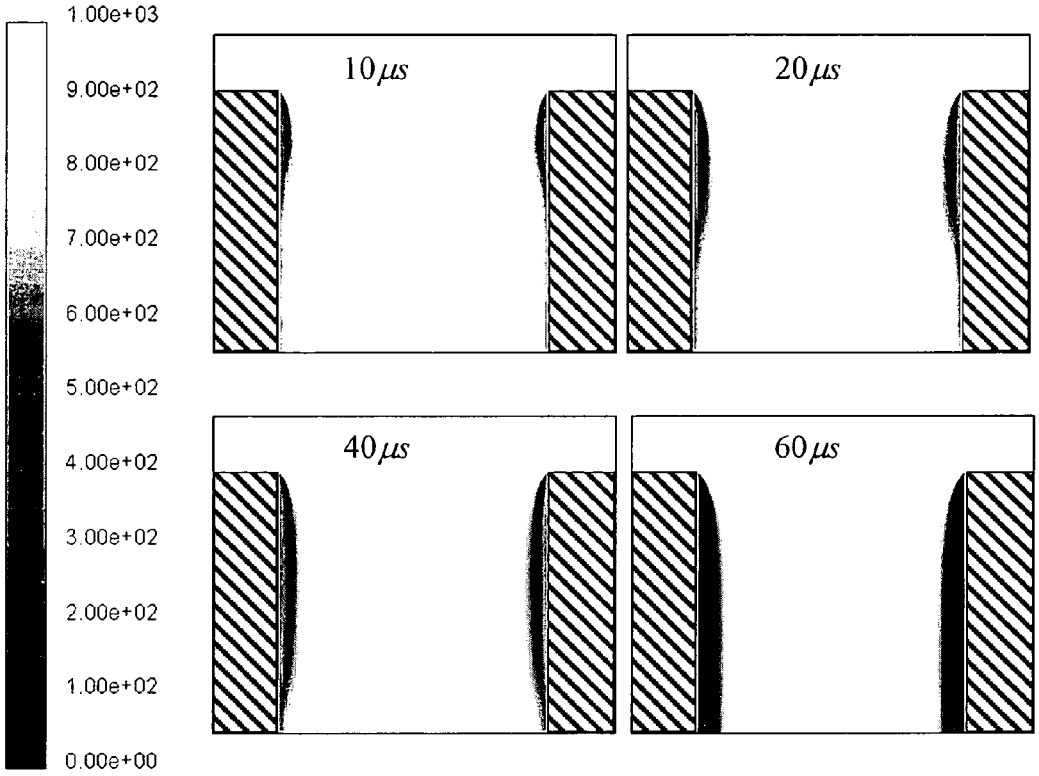
FIG. 8 is a contour plot of the mixture density in kg/m3 inside the nozzle hydroentangling strip capillary section versus time.
Figures 9A, 9B, 9C:
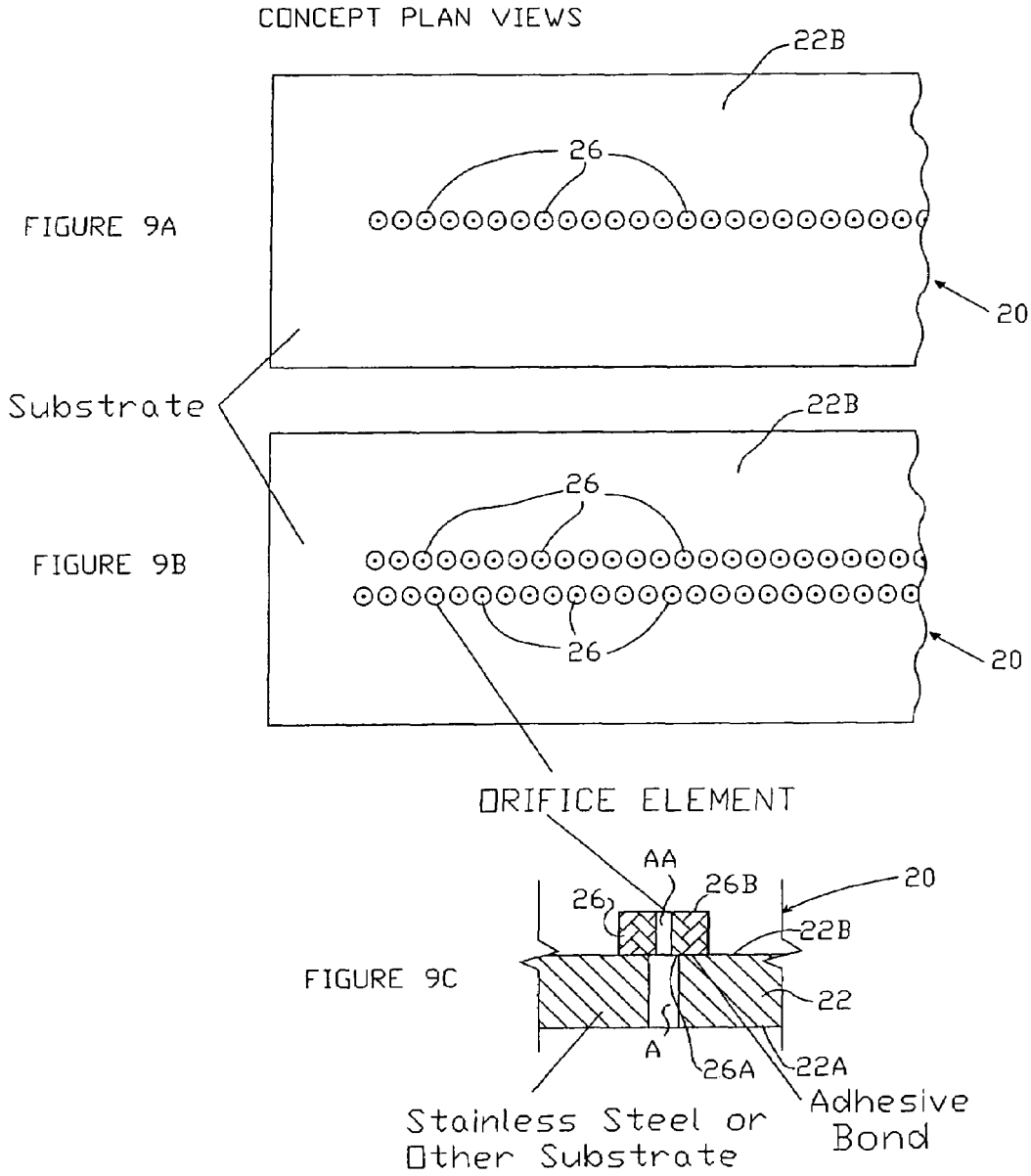
FIGS. 9A–9C are top plan and vertical cross-sectional views of a composite nozzle strip including an embodiment of a plurality of orifice elements provided in accordance with the subject matter disclosed herein.

With reference to FIGS. 9A–9C, the composite nozzle strip of the present invention is generally shown as 20. Composite nozzle strip 20 comprises a substrate 22 having a first side surface 22A and a second side surface 22B and further defining at least one aperture A of a first diameter. Substrate 22 is comprised of a material of a first hardness, preferably stainless steel or some other type of non-corrosive metal. At least one aperture A in substrate 22 can be cylindrical or may be conical and can be formed by laser drilling, electrical discharge machining, micro drilling, water jet drilling, or by any other means known to those of skill in the art.

Composite nozzle strip 20 further comprises at least one orifice element 26 having a first side surface 26A and a second side surface 26B and further defining an aperture AA of a second diameter. The second diameter of orifice element aperture AA is less than the first diameter of substrate aperture A. Orifice element 26 is comprised of a material of a second hardness, which is greater than the first hardness of substrate 22, and preferably is comprised of a hard single crystal material, such as diamond, sapphire, zirconia, ruby or ceramic. Orifice element 26 may also be comprised of a hard polycrystalline material, such as alumina or silicon carbide; a hard composite material, such as cemented tungsten carbide or cemented diamond; or a hard amorphous material, such as glass. The aspect ratio of orifice element 26 is preferably between 0.1 and 10 and may be simply adjusted to the optimum value for the pressure employed by adjusting the thickness of the element. Typically, the length of orifice aperture AA is 0.015 inches and diameter is 0.005 inches, for a resultant aspect ratio of 3.0. The entrance sharpness ratio (ratio of the inlet edge radius of curvature to the diameter of aperture AA) is preferably less than or equal to 0.06.

In order to form composite nozzle strip 20 with the desired properties discussed hereinabove, first side surface 26A of at least one orifice element 26 is affixed to second side surface 22B of substrate 22 so that each orifice element aperture AA is aligned with apertures A in substrate 22. In order to keep orifice element 26 in place and to provide sealing, orifice element 26 may be rigidly affixed to substrate 22 through the use of an adhesive such as UV activated glue or an epoxy. Substrate apertures A and overlying orifice elements 26 may be in one or more rows as shown in FIGS. 9A and 9B such that the density of the apertures is in the range of 1 to 200 apertures per inch.

Figures 10A, 10B, 10C:
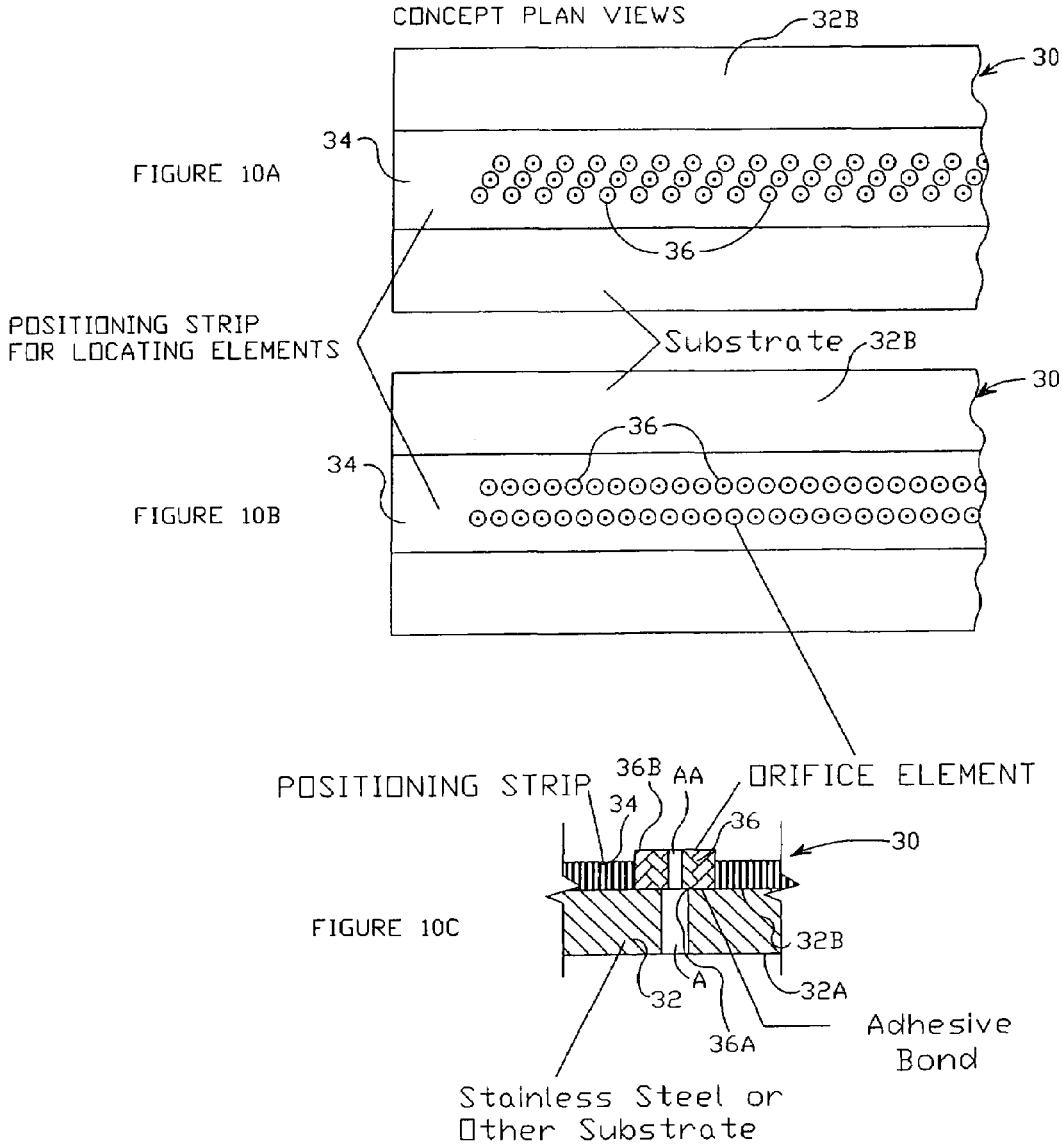
FIGS. 10A–10C are top plan and vertical cross-sectional views of a composite nozzle strip including an embodiment of a positioning strip including a plurality of orifice elements provided in accordance with the subject matter disclosed herein.

With reference to FIGS. 10A–10C, another embodiment of a composite nozzle strip of the present invention is shown generally as 30. Composite nozzle strip 30 in this embodiment comprises a substrate 32 having a first side surface 32A and a second side surface 32B and further defining at least one aperture A of a first diameter. Substrate 32 and at least one aperture A may be formed and shaped similarly to substrate 22 described hereinabove.

Composite nozzle strip 30 of this embodiment further comprises a positioning strip 34 including a plurality of orifice elements 36, each orifice element 36 having a first side surface 36A and a second side surface 36B and further defining an aperture AA of a second diameter. The second diameter of orifice element aperture AA is less than the first diameter of substrate aperture A and orifice element 36 is comprised of a material of a second hardness, which is greater than the first hardness of substrate 32 and preferably is comprised of any material described hereinabove in relation to orifice element 26.

Composite nozzle strip 30 in this embodiment is formed by placing positioning strip 34 on substrate 32 so that first side surfaces 36A of the plurality of orifice elements 36 are affixed to second side surface 32B of substrate 32. Positioning strip 34 is placed so that apertures AA of orifice elements 36 are aligned with apertures A in substrate 32. Positioning strip 34 can be comprised of a thermoplastic elastomer, such as nylon, MYLAR®, or rubber. Positioning strip 34 may be bonded to substrate 32 along with orifice elements 36, or orifice elements 36 may be removably affixed to positioning strip 34 wherein positioning strip 34 can be peeled away when orifice elements 36 are bonded to substrate 32.

Figure 11A:
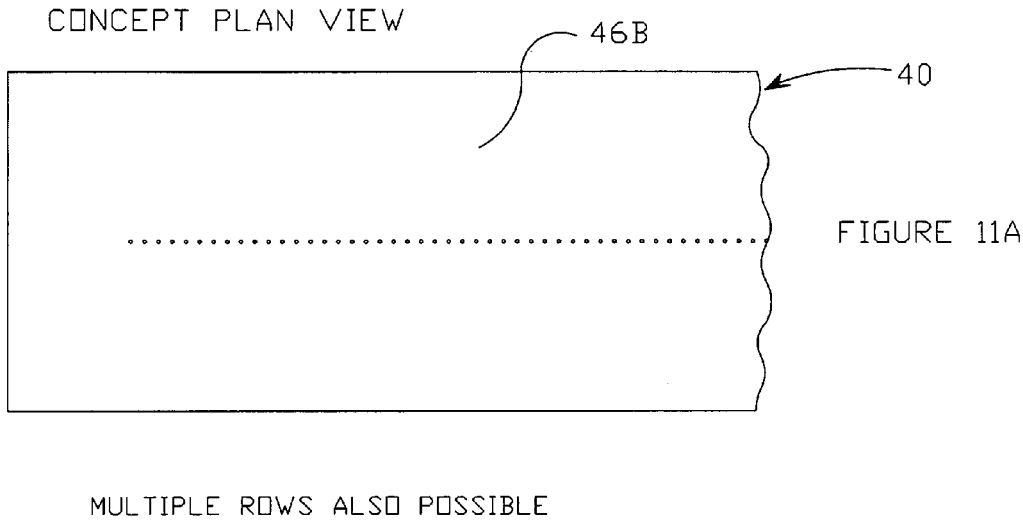
FIGS. 11A and 11B are top plan and vertical cross-sectional views of a composite nozzle strip including an embodiment of an orifice strip provided in accordance with the subject matter disclosed herein.
Figure 11B:
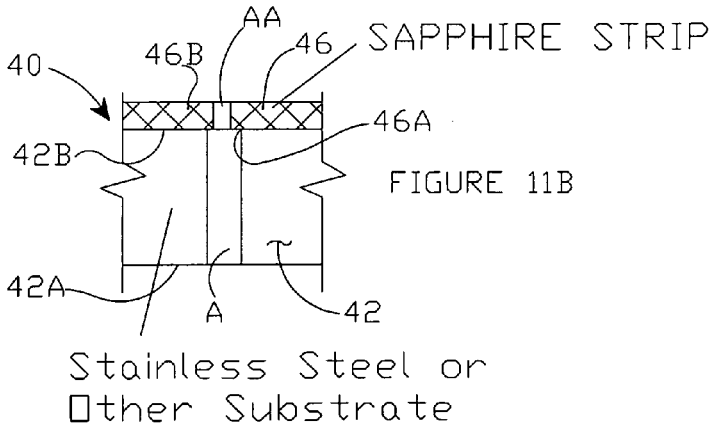

With reference to FIGS. 11A and 11B, another embodiment of a composite nozzle strip of the present invention is shown generally as 40. Composite nozzle strip 40 in this embodiment comprises a substrate 42 having a first side surface 42A and a second side surface 42B and further defining at least one aperture A of a first diameter. Substrate 42 and at least one aperture A may be formed and shaped similarly to substrates 22 and 32 described hereinabove.

Composite nozzle strip 40 of this embodiment further comprises an orifice strip 46 having a first side surface 46A and a second side surface 46B. Orifice strip 46 is comprised of a material of a second hardness, which is greater than the first hardness of substrate 42 and preferably is comprised of any material described hereinabove in relation to orifice elements 26 and 36. Orifice strip 46 further comprises a plurality of apertures AA of a second diameter, which is less than the first diameter of substrate aperture A.

Composite nozzle strip 40 in this embodiment is formed by affixing orifice strip first side surface 46A to substrate second side surface 42B so that the plurality of orifice strip apertures AA are aligned with the plurality of substrate apertures A. In order to provide bonding and sealing, orifice strips 46 may be rigidly affixed to substrate 42 through the use of an adhesive such as UV activated glue or epoxy.

Orifice strips 46 could be segmented in short lengths to eliminate the bending caused by handling the nozzle strip assembly and in practice when one nozzle jet failed, the short length of strip would be replaced. This operational layout would allow for a very close spacing of orifice strip apertures AA without staggering the layout as required with the use of individual orifice elements 26 and 36. Additionally, assembly and replacement of orifice strips 46 would require minimal effort because of increased size and reduced number of pieces being handled.

Methods of producing nonwoven fabrics in accordance with the present invention are also disclosed. The methods comprise providing a substrate as described hereinabove, having a first side surface, a second side surface, at least one aperture of a first diameter and comprising a material of a first hardness. The methods also comprise providing at least one orifice element, a positioning strip including a plurality of orifice elements, or an orifice strip, all as described hereinabove and including a first side surface, a second side surface, an aperture of a second diameter less than the first diameter and comprising a material of a second hardness greater than the first hardness. The first side surfaces of the at least one orifice element, positioning strip including a plurality of orifice elements, or the orifice strip are affixed to the second side surface of the substrate so that the apertures in the orifice elements (or equivalent) are aligned with the apertures in the substrate.

The methods further comprise exposing the apertures in the orifice elements (or equivalent) to pressurized water to form at least one water jet, guiding a fibrous web onto a supporting member beneath the at least one water jet, and subjecting the fibrous web to the at least one water jet and thereby providing enhanced cohesion and appearance modification to the fibrous web.

It will be understood that various details of the invention may be changed without departing from the scope of the invention. Furthermore, the foregoing description is for the purpose of illustration only, and not for the purpose of limitation, as the invention is defined by the claims as set forth hereinafter.

What is claimed is:

1. In a hydroentangling apparatus for fibrous masses comprising one or more nozzles, the improvement comprising a composite nozzle strip for hydroentangling comprising:

(a) a substrate having a first side surface and a second side surface comprising a material of a first hardness, the substrate having at least one aperture of a first diameter;

(b) at least one orifice element having a first side surface and a second side surface comprising a material of a second hardness greater than the first hardness, and further defining an aperture of a second diameter less than the first diameter; and (c) wherein the first side surface of the at least one orifice element is affixed to the second side surface of the substrate such that no portion of the at least one orifice element extends into the at least one aperture in the substrate and further so that the aperture in the at least one orifice element is aligned with the at least one aperture in the substrate, and further wherein the first side surface of the at least one orifice element that surrounds the aperture in the at least one orifice element is substantially co-planar to the second side surface of the substrate.

2. The hydroentangling apparatus of claim 1 wherein the substrate is comprised of metal.

3. The hydroentangling apparatus of claim 2 wherein the metal is stainless steel.

4. The hydroentangling apparatus of claim 1 wherein the at least one aperture in the substrate is cylindrical.

5. The hydroentangling apparatus of claim 1 wherein the at least one aperture in the substrate is conical.

6. The hydroentangling apparatus of claim 1 wherein the at least one aperture in the substrate is formed by one of laser drilling, electrical discharge machining, micro drilling, and water jet drilling.

7. The hydroentangling apparatus of claim 1 wherein the density of the at least one aperture in the substrate is 1 to 200 apertures per inch.

8. The hydroentangling apparatus of claim 1 wherein the at least one orifice element is comprised of a hard single crystal material.

9. The hydroentangling apparatus of claim 8 wherein the hard single crystal material is selected from the group consisting of diamond, sapphire, zirconia, ruby, and ceramic.

10. The hydroentangling apparatus of claim 1 wherein the at least one orifice element is comprised of a hard polycrystalline material.

11. The hydroentangling apparatus of claim 10 wherein the hard polycrystalline material is one of alumina and silicon carbide.

12. The hydroentangling apparatus of claim 1 wherein the at least one orifice element is comprised of a hard composite material.

13. The hydroentangling apparatus of claim 12 wherein the hard composite material is one of cemented tungsten carbide and cemented diamond.

14. The hydroentangling apparatus of claim 1 wherein the at least one orifice element is comprised of a hard amorphous material.

15. The hydroentangling apparatus of claim 14 wherein the hard amorphous material is glass.

16. The hydroentangling apparatus of claim 1 wherein the first side surface of the at least one orifice element is rigidly affixed to the second side surface of the substrate.

17. The hydroentangling apparatus of claim 16 wherein the at least one orifice element is rigidly affixed to the substrate with an adhesive.

18. The hydroentangling apparatus of claim 17 wherein the adhesive is one of UV activated glue and epoxy.

19. The hydroentangling apparatus of claim 1 wherein the aspect ratio of the at least one orifice element aperture is between 0.1 and 10.

20. The hydroentangling apparatus of claim 1 wherein the entrance sharpness ratio of the at least one orifice element aperture is less than or equal to 0.06.

21. In a hydroentangling apparatus for fibrous masses comprising one or more nozzles, the improvement comprising a composite nozzle strip for hydroentangling comprising:

(a) a substrate having a first side surface and a second side surface comprising a material of a first hardness, the substrate having a plurality of apertures of a first diameter;

(b) a positioning strip including a plurality of orifice elements, each orifice element having a first side surface and a second side surface comprising a material of a second hardness greater than the first hardness, and further defining an aperture of a second diameter less than the first diameter; and (c) wherein the positioning strip is placed on the substrate so that the first side surfaces of the plurality of orifice elements are affixed to the second side surface of the substrate so that the apertures of the plurality of orifice elements are aligned with the plurality of apertures in the substrate.

22. The hydroentangling apparatus of claim 21 wherein the substrate is comprised of metal.

23. The hydroentangling apparatus of claim 22 wherein the metal is stainless steel.

24. The hydroentangling apparatus of claim 21 wherein the plurality of apertures in the substrate are cylindrical.

25. The hydroentangling apparatus of claim 21 wherein the plurality of apertures in the substrate are conical.

26. The hydroentangling apparatus of claim 21 wherein the plurality of apertures in the substrate are formed by one of laser drilling, electrical discharge machining, micro drilling, and water jet drilling.

27. The hydroentangling apparatus of claim 21 wherein the density of the plurality of apertures in the substrate is 2 to 200 apertures per inch.

28. The hydroentangling apparatus of claim 21 wherein the positioning strip is comprised of a thermoplastic elastomer.

29. The hydroentangling apparatus of claim 28 wherein the thermoplastic elastomer is selected from the group consisting of nylon, MYLAR®, and rubber.

30. The hydroentangling apparatus of claim 21 wherein the plurality of orifice elements are removably affixed to the positioning strip.

31. The hydroentangling apparatus of claim 21 wherein the plurality of orifice elements are comprised of a hard single crystal material.

32. The hydroentangling apparatus of claim 31 wherein the hard single crystal material is selected from the group consisting of diamond, sapphire, zirconia, ruby, and ceramic.

33. The hydroentangling apparatus of claim 21 wherein the plurality of orifice elements are comprised of a hard polycrystalline material.

34. The hydroentangling apparatus of claim 33 wherein the hard polycrystalline material is one of alumina and silicon carbide.

35. The hydroentangling apparatus of claim 21 wherein the plurality of orifice elements are comprised of a hard composite material.

36. The hydroentangling apparatus of claim 35 wherein the hard composite material is one of cemented tungsten carbide and cemented diamond.

37. The hydroentangling apparatus of claim 21 wherein the plurality of orifice elements are comprised of a hard amorphous material.

38. The hydroentangling apparatus of claim 37 wherein the hard amorphous material is glass.

39. The hydroentangling apparatus of claim 21 wherein the first side surfaces of the plurality of orifice elements are rigidly affixed to the second side surface of the substrate.

40. The hydroentangling apparatus of claim 39 wherein the plurality of orifice elements are rigidly affixed to the substrate with an adhesive.

41. The hydroentangling apparatus of claim 40 wherein the adhesive is one of UV activated glue and epoxy.

42. The hydroentangling apparatus of claim 21 wherein the aspect ratio of the plurality of orifice element apertures is between 0.1 and 10.

43. The hydroentangling apparatus of claim 21 wherein the entrance sharpness ratio of the plurality of orifice element apertures is less than or equal to 0.06.

44. In a hydroentangling apparatus for fibrous masses comprising one or more nozzles, the improvement comprising a composite nozzle strip for hydroentangling comprising:

(a) a substrate having a first side surface and a second side surface comprising a material of a first hardness, the substrate having a plurality of apertures of a first diameter;

(b) an orifice strip having a first side surface and a second side surface comprising a material of a second hardness greater than the first hardness, the orifice strip having a plurality of apertures of a second diameter less than the first diameter; and (c) wherein the first side surface of the orifice strip is affixed to the second side surface of the substrate so that the plurality of apertures in the orifice strip are aligned with the plurality of apertures in the substrate.

45. The hydroentangling apparatus of claim 44 wherein the substrate is comprised of metal.

46. The hydroentangling apparatus of claim 45 wherein the metal is stainless steel.

47. The hydroentangling apparatus of claim 44 wherein the plurality of apertures in the substrate are cylindrical.

48. The hydroentangling apparatus of claim 44 wherein the plurality of apertures in the substrate are conical.

49. The hydroentangling apparatus of claim 44 wherein the plurality of apertures in the substrate are formed by one of laser drilling, electrical discharge machining, micro drilling, and water jet drilling.

50. The hydroentangling apparatus of claim 44 wherein the density of the plurality of apertures in the substrate is 2 to 200 apertures per inch.

51. The hydroentangling apparatus of claim 44 wherein the orifice strip is comprised of a hard single crystal material.

52. The hydroentangling apparatus of claim 51 wherein the hard single crystal material is selected from the group consisting of diamond, sapphire, zirconia, ruby, and ceramic.

53. The hydroentangling apparatus of claim 44 wherein the orifice strip is comprised of a hard polycrystalline material.

54. The hydroentangling apparatus of claim 53 wherein the hard polycrystalline material is one of alumina and silicon carbide.

55. The hydroentangling apparatus of claim 44 wherein the orifice strip is comprised of a hard composite material.

56. The hydroentangling apparatus of claim 55 wherein the hard composite material is one of cemented tungsten carbide and cemented diamond.

57. The hydroentangling apparatus of claim 44 wherein the orifice strip is comprised of a hard amorphous material.

58. The hydroentangling apparatus of claim 57 wherein the hard amorphous material is glass.

59. The hydroentangling apparatus of claim 44 wherein the plurality of apertures in the orifice strip are formed by one of laser drilling, electrical discharge machining, micro drilling, and water jet drilling.

60. The hydroentangling apparatus of claim 44 wherein the first side surface of the orifice strip is rigidly affixed to the second side of the substrate.

61. The hydroentangling apparatus of claim 60 wherein the orifice strip is rigidly affixed to the substrate with an adhesive.

62. The hydroentangling apparatus of claim 61 wherein the adhesive is one of UV activated glue and epoxy.

63. The hydroentangling apparatus of claim 44 wherein the aspect ratio of the orifice strip apertures is between 0.1 and 10.

64. The hydroentangling apparatus of claim 44 wherein the entrance sharpness ratio of the orifice strip apertures is less than or equal to 0.06.

65. A method of producing nonwoven fabrics, the method comprising:

(a) providing a composite novel strip comprising a substrate having a first side surface and a second side surface comprising a material of a first hardness, the substrate having at least one aperture of a first diameter; at least one orifice element having a first side surface and a second side surface comprising a material of a second hardness greater than the first hardness, and further defining an aperture of a second diameter less than the first diameter; wherein the first side surface of the at least one orifice element is affixed to the second side surface of the substrate such that no portion of the at least one orifice element extends into the at least one aperture in the substrate and further so that the aperture in the at least one orifice element is aligned with the at least one aperture in the substrate, and further wherein the first side surface of the at least one orifice element that surrounds the aperture in the at least one orifice element is substantially co-planar to the second side surface of the substrate;

(b) exposing the aperture of the at least one orifice element to pressurized water to form at least one water jet;

(c) guiding a fibrous web onto a supporting member beneath the at least one water jet; and (d) subjecting the fibrous web to the at least one water jet and thereby providing enhanced cohesion and appearance modification to the fibrous web.

66. A method of producing nonwoven fabrics, the method comprising:

(a) providing a composite novel strip comprising a substrate having a first side surface and a second side surface comprising a material of a first hardness, the substrate having a plurality of apertures of a first diameter; a positioning strip including a plurality of orifice elements, each orifice element having a first side surface and a second side surface comprising a material of a second hardness greater than the first hardness, and further defining an aperture of a second diameter less than the first diameter; wherein the positioning strip is placed on the substrate so that the first side surfaces of the plurality of orifice elements are affixed to the second side surface of the substrate so that the apertures of the plurality of orifice elements are aligned with the plurality of apertures in the substrate;

(b) exposing the orifice elements to pressurized water to form a plurality of water jets;

(c) guiding a fibrous web onto a supporting member beneath the plurality of water jets; and (d) subjecting the fibrous web to the plurality of water jets and thereby providing enhanced cohesion and appearance modification to the fibrous web.

67. A method of producing nonwoven fabrics, the method comprising:

(a) providing a composite novel strip comprising a substrate having a first side surface and a second side surface comprising a material of a first hardness, the substrate having a plurality of apertures of a first diameter; an orifice strip having a first side surface and a second side surface comprising a material of a second hardness greater than the first hardness, the orifice strip having a plurality of apertures of a second diameter less than the first diameter; wherein the first side surface of the orifice strip is affixed to the second side surface of the substrate so that the plurality of apertures in the orifice strip are aligned with the plurality of holes in the substrate;

(b) exposing the plurality of apertures in the orifice strip to pressurized water to form a plurality of water jets;

(c) guiding a fibrous web onto a supporting member beneath the plurality of water jets; and (d) subjecting the fibrous web to the plurality of water jets and thereby providing enhanced cohesion and appearance modification to the fibrous web.

* * * * *